United States Patent [19]

Weiss

[11] Patent Number: 4,912,739

[45] Date of Patent: Mar. 27, 1990

[54] ROTATING ANODE X-RAY TUBE WITH DEFLECTED ELECTRON BEAM

[76] Inventor: Mortimer E. Weiss, 776 Barracuda, Laguna Beach, Calif. 92651

[21] Appl. No.: 99,123

[22] Filed: Sep. 21, 1987

[51] Int. Cl.[4] ..... H01J 35/30

[52] U.S. Cl. ..... 378/137; 378/130; 378/140; 378/144; 378/125

[58] Field of Search ..... 378/121, 130, 136–137, 378/140, 144, 161, 125

[56] References Cited

U.S. PATENT DOCUMENTS

| | | | |
|---|---|---|---|
| 2,168,780 | 8/1939 | Olshevsky | 378/140 |
| 3,867,637 | 2/1975 | Braun et al. | 378/121 |
| 3,894,239 | 7/1975 | Braun | 378/140 |
| 4,104,531 | 8/1978 | Weiss | 378/161 |
| 4,206,356 | 6/1980 | Wardley et al. | 378/137 |
| 4,250,425 | 2/1981 | Gabbay et al. | 378/137 |
| 4,405,876 | 9/1983 | Iversen | 378/130 |
| 4,607,380 | 8/1986 | Oliver | 378/130 |
| 4,674,109 | 6/1987 | Ono | 378/130 |
| 4,679,219 | 7/1987 | Ozaki | 378/136 |
| 4,768,212 | 8/1988 | Appelt et al. | 378/130 |

FOREIGN PATENT DOCUMENTS

| | | | |
|---|---|---|---|
| 0030453 | 6/1981 | European Pat. Off. | 378/137 |

*Primary Examiner*—Craig E. Church
*Assistant Examiner*—John C. Freeman

[57] ABSTRACT

A microfocus X-ray tube having a rotating anode wherein X-ray are generated by electron beam bombardment of the anode and wherein the electron beam is bent as by a magnetic field to impinge on a selected surface of the anode.

4 Claims, 1 Drawing Sheet

FIG. 1
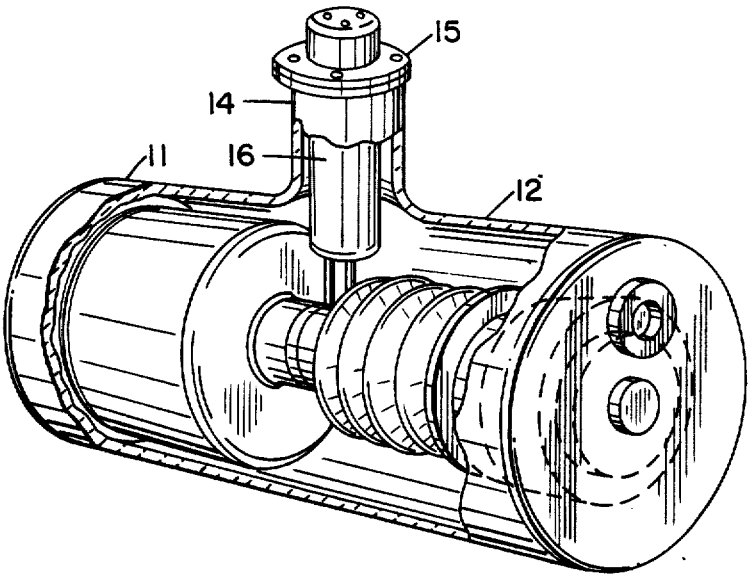
FIG. 2A
FIG. 2
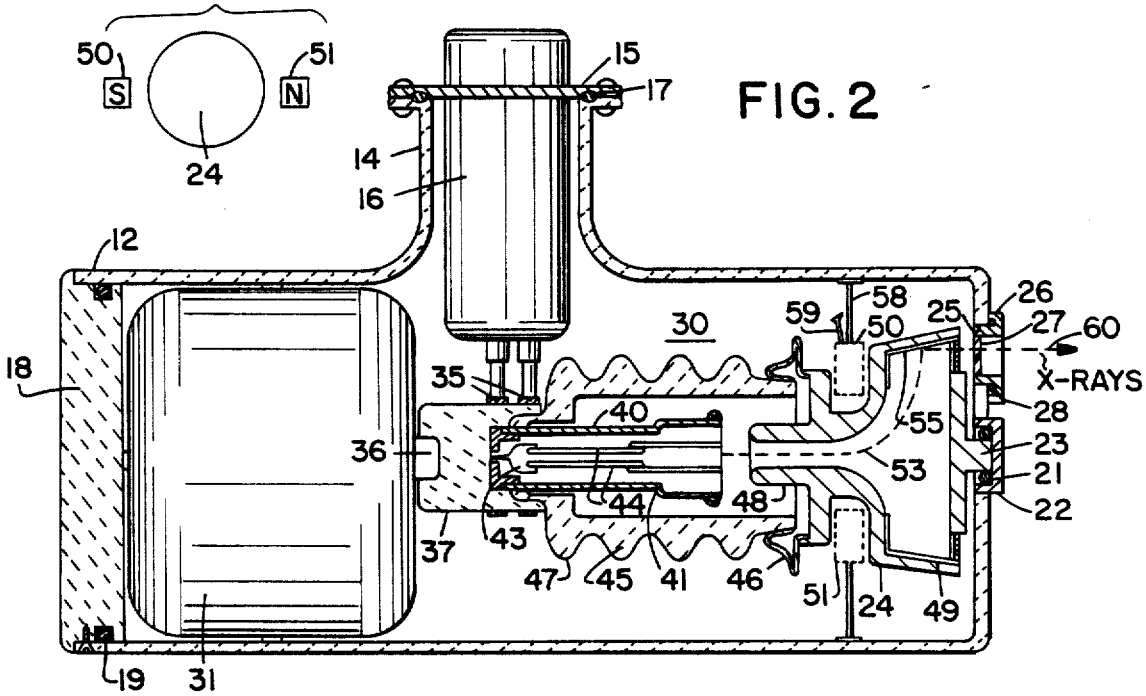

ROTATING ANODE X-RAY TUBE WITH DEFLECTED ELECTRON BEAM

BACKGROUND OF THE INVENTION

In rotating anode type X-ray tubes it is necessary to locate the anode target axially relative to the electron beam impinging thereon to obtain the necessary focal spot stability. One present type of rotating anode tube utilizes an anode structure, normally of tungsten, which anode is quite massive and supported in cantilever configuration. Other such rotating anode tubes may have a rotating anode wherein both ends of the anode structure are supported by bearing means such as shown in U.S. Pat. No. 4,545,064.

In prior art devices, a high intensity electron beam is directed through a vacuum at the tungsten anode target which converts the electron beam to X-rays which are then bounced off of the anode and directed outwardly through a filtering window onto the subject. The electron beam is of a very high intensity such that if the tungsten target is not rotated, the beam evaporates material on the target or burns the target. Accordingly, the tungsten anode (target) must be driven to rotate at a high speed to dissipate the heat. Powerful starters drive the anode target from an initial stop condition to 10,000 rpm in a fraction of a second before the exposure is made and stop the anode target in a short time after the exposure.

SUMMARY OF THE INVENTION

An important difference between the present X-ray tubes and the microfocus rotating anode tube of the invention is that the electron beam is formed by an electron gun and bent to impinge on a relatively thin target sleeve affixed to a relatively lightweight, dynamically balanced rotating anode also thus eliminating the need for the starters of the prior art.

In another embodiment associated with the basic design, a simple dual beam X-ray tube for stereo (3-dimensional) X-radiography can be set up with this tube using a single electron beam gun. In this case the polarization of the magnetic field is selectively reversed so that the second X-ray beam emerges at 180° or diametrically opposite from the first beam.

BRIEF DESCRIPTION OF THE DRAWINGS

FIG. 1 is an isometric view of the X-ray tube of the invention;

FIG. 2 is a side view, partially in cross section, of the tube of FIG. 1; and

FIG. 2A is a sketch useful in explaining the X-ray tube of FIGS. 1 and 2.

DETAILED DESCRIPTION

FIG. 1 shows an isometric view of one embodiment of the microfocus rotating anode tube with a deflectable electron beam 53 of the invention. The tube 11 includes cylindrically shaped envelope 12 which may be of a ceramic, glass or metal material. The envelope includes a neck portion 14 extending from the side of the envelope. A flange 15 covers the open end of the neck 14. The cove includes a high voltage cable termination socket 16 which is centrally mounted therein. Flange 15 together with a suitable ring seal 17 seals the interior of the tube from the atmosphere. A suitable end cap 18, also with a suitable ring seal 19, seals one end of the envelope. The other end of envelope 12 is essentially closed but includes a central opening 21 which receives a bearing assembly 22 to support the axial shaft 23 of an anode 24, to be explained. Envelope 12 includes an opening 25 laterally spaced from opening 21 to provide a means of mounting an X-ray transparent window assembly 26 which in turn supports the X-ray transparent window 27, of titanium. A suitable ring seal 17 is provided for assembly 26.

The interior of the envelope 12 is filled with heat dissipating oil 30. An electric motor 31 is mounted within the tube envelope 12. The motor may comprise a synchronous 3300 RPM ⅛ H.P. 120V AC (dynamic balanced motor). The power to the motor is obtained through socket 16 and suitable slip rings 35 which conventionally connect to the motor 31. The drive shaft 36 of motor 31 connects to a base support 37 as will be explained.

An electron beam producing and focusing assembly or electron gun 40 include an open ended cylindrical cup-shaped tube 41, filaments 43, and focusing electrode sleeves 44. A cylindrical ceramic sleeve 45 is positioned to surround the electron gun 40. Ceramic cylinder 45 and the closed end of electron gun 40 are mounted in a receiving recess in base 37 Ceramic cylinder 45 has an undulating or corrugated outer surface 47. Electron gun 40 is mounted in coaxial relation with ceramic cylinder 45, and the anode 24 is mounted as by a flange 46 onto the ceramic cylinder 45. Flange 46 may be brazed onto anode 24 and cylinder 45.

Anode 24 comprises a hollow frustoconical shaped member having a small open end 48 and a larger, essentially closed end 49. As mentioned, anode 24 is co-axially mounted with assembly 40, cylinder 45, base 37 and motor shaft 36. The open end 48 of anode 24 extends inwardly of cylinder 45 toward the electron gun 40. An electron beam 53 is developed and focused by electron gun 40 and moves in an axial direction toward and through the open end of anode 24.

The closed end 49 of anode 24 includes the forwardly extending axial shaft 23 which is mounted for rotation on bearing assembly 22. Accordingly the anode 24 is rotatably supported by bearing assembly 22 and permits rotation of anode 24, the cylinder 45, electron gun 40 and base 37 with shaft 36 of motor 31. As mentioned, electrical contact is made to motor 31 through slip rings 35.

The interior of anode 24 and the interior of ceramic cylinder 45 are evacuated to form a vacuum environment. Oil 30 is provided externally of the anode 24 and within envelope 12 to provide a cooling medium.

A magnetic field is developed as by permanent magnetic means or by electromagnetic means depicted at 50 and 51, and connected as is well known as a cable 59, to the source of power available at socket 16. The magnetic means 50 and 51 are suitably affixed as at 58 to the interior surface of the envelope 12. The magnetic means 50 and 51 as depicted in FIG. 2 are actually positioned as shown in FIG. 2A to deflect the electron upwardly, that is, 90° rotated from that shown in FIG. 2, as oriented in FIG. 2.

A tungsten sleeve or surface 55 is positioned, or formed, on the interior frustoconical surface of anode 24. As is known, when the electron beam 53 impinges or strikes the tungsten surface 55 an X-ray beam 60 is created or generated. The X-ray beam 60 deflects or bounces from surface 55 and exits through X-ray transparent window 27.

In operation, electron gun 40 provides an electron beam 53 which is deflected from its axial path towards the electron gun rotating frustoconical angled surface to develop the X-ray beam 60 which then exits through window 27.

The rotating anode tube with the deflectable beam 53 provides a simplified rotating anode design for the production of high intensity X-ray radiation in vacuum tubes. Besides the obvious cost reduction in the rotating anode tubes, several factors limiting the useful life of existing tubes that are also overcome by the invention. These improvements include:

(a) elimination of internal bearing and associated wear, galling, and lubrication problems of contacting metal surfaces moving at high speed in vacuum.

(b) elimination of a heavy synchronous AC motor rotor, and cantilever supported shaft and bearings resulting in vibration and stress on the glass-to-metal seal at one end of existing tubes. Glass tubes are further weakened by devitrification due to intense X-radiation within the tube.

(c) improvement in anode cooling because the anode is directly cooled by conduction, by convection in the cooling medium as well as by radiation. Existing tubes are cooled only by radiation.

(d) the high electron beam can be shifted from one peripheral track to another by a simple mechanical or electromagnetic change in the beam-bending or deflecting magnetic field. Thus the electron beam is not restricted to one track which can result in tungsten evaporation, etching and cratering of the target surface and resulting circumferential groove. In the prior art, the X-ray beam emission from this groove is absorbed by the target in a direction normal to the plastic window with a marked reduction in X-ray output at extended life operation.

The envelope of the tube can be made either of glass, ceramic or metal with radial coaxial insulators. The electron gun is the same as those used in conventional X-ray or electron beam tubes and the electron optics determined by the same geometrical arrangement as in existing tubes. However, the electron beam is uniquely deflected or bent to a fixed position on the rotating anode (target) surface.

As mentioned above, in FIG. 2, the magnetic pole pieces are shown rotated 90 from their true position to produce the electron and X-ray beams, as shown, aligned with the exit window 27. The magnetic field providing means are depicted in FIG. 2A and are 90° should be 90° from the plane of the beam (in this drawing the surface of the paper) since the electron beam is always bent at right angles to the direction of the magnetic field.

While the invention has been particularly shown and described with reference to a preferred embodiment thereof, it will be understood by those skilled in the art that various changes in form and details may be made therein without departing from the spirit and scope of the invention.

I claim:

1. An X-ray tube wherein an electron beam is caused to impinge on an anode to generate X-rays comprising in combination:

a first fluid tight envelope;

a fluid in said first fluid tight envelope;

a second vacuum tight envelope mounted for rotation, within said first envelope;

a motor means operatively connected to said second vacuum tight envelope for rotating said second vacuum tight envelope in said fluid;

a source for generating an electron beam, wherein said source is located within said second vacuum tight envelope;

an anode having a surface displaced from a longitudinal axis of said anode for generating X-rays when impinged by said electron beam, wherein said anode is located within and rotates with said second vacuum tight envelope;

said electron beam being directed along a path in an axial direction relative to said anode rotation;

an electron beam deflection means mounted adjacent said electron beam path to cause said electron beam to be selectively deflected from said axial direction to impinge on said X-ray generating surface of said anode;

an X-ray transparent window for said first fluid tight envelope to enable generated X-rays to pass through said first fluid tight envelope; an x-ray transparent window for said second vacuum tight envelope to enable said generated x-rays to pass through said second vacuum tight envelope; and said X-ray generating surface directing said X-rays generated by the impingement of said electrons thereon through each of said windows of said first fluid tight envelope and said second vacuum tight envelope.

2. An X-ray tube wherein an electron beam is caused to impinge on an anode to generate X-rays comprising in combination;

a first envelope;

a fluid in said first envelope;

a second vacuum tight tube envelope mounted for rotation within said first envelope and in said fluid;

motor means mounted within said first envelope and connected to said second vacuum tight tube envelope for selectively rotating said second vacuum tight tube envelope;

a source for generating an electron beam;

an anode mounted within said second envelope;

said anode having an angled side surface;

said source for generating an electron beam being mounted in said second vacuum tight tube envelope;

said anode being formed as a hollow member having an angled interior side surface;

said electron beam being directed toward the anode along an axially direction relative to said second vacuum tight tube envelope rotation;

a magnetic field means mounted adjacent said first envelope and adjacent the electron beam path;

said magnetic field means causing said electron beam to be deflected from its axial path to impinge on said angled interior side surface of said anode;

said angled interior side surface of said anode comprising an X-ray generating medium for generating X-rays due to the impingement thereon of electrons, which X-rays can be directed in a selected direction; and, a first X-ray transparent window on said anode to enable said generated X-rays to pass therethrough, said first X-ray transparent window also forming a surface of said second envelope, and, a second X-ray transparent window on said first envelope positioned in alignment with the X-ray path through said first X-ray transparent window.

3. An X-ray tube as in claim 2 wherein said source for generating an electron beam comprises filament members and a tubular cathode, and a cylindrical ceramic member for maintaining a vacuum environment for said electron beam source.

4. An X-ray tube as in claim 3 wherein said first envelope maintains said anode and said cylindrical ceramic member in a liquid bath, and wherein said cylindrical ceramic member and said anode maintain the electron beam in a vacuum environment.

* * * * *

UNITED STATES PATENT AND TRADEMARK OFFICE

CERTIFICATE OF CORRECTION

PATENT NO. : 4,912,739

DATED : March 27, 1990

INVENTOR(S) : Mortimer E. Weiss

It is certified that error appears in the above-identified patent and that said Letters Patent is hereby corrected as shown below:

In Fig. 2, electron gun 40 is shown in a reversed (flip-flopped) position. The filament 43 end of gun 40 should be on the right; and, the opposite, or tube 41 end of gun 40, should be on the left.

Signed and Sealed this

Sixth Day of August, 1991

*Attest:*

HARRY F. MANBECK, JR.

*Attesting Officer*

*Commissioner of Patents and Trademarks*